US012601155B2

(12) United States Patent
Noda et al.

(10) Patent No.: US 12,601,155 B2
(45) Date of Patent: Apr. 14, 2026

(54) COMPACTION MANAGEMENT SYSTEM

(71) Applicant: KOBELCO CONSTRUCTION MACHINERY CO., LTD., Hiroshima (JP)

(72) Inventors: Daisuke Noda, Hiroshima (JP); Sho Fujiwara, Hiroshima (JP); Yusuke Kamimura, Hiroshima (JP)

(73) Assignee: KOBELCO CONSTRUCTION MACHINERY CO., LTD., Hiroshima (JP)

( * ) Notice: Subject to any disclaimer, the term of this patent is extended or adjusted under 35 U.S.C. 154(b) by 547 days.

(21) Appl. No.: 17/999,317

(22) PCT Filed: May 17, 2021

(86) PCT No.: PCT/JP2021/018593
§ 371 (c)(1),
(2) Date: Nov. 18, 2022

(87) PCT Pub. No.: WO2021/241301
PCT Pub. Date: Dec. 2, 2021

(65) Prior Publication Data

US 2023/0183948 A1 Jun. 15, 2023

(30) Foreign Application Priority Data

May 28, 2020 (JP) ..... 2020-093296

(51) Int. Cl.
*E02F 9/26* (2006.01)
*E02F 3/32* (2006.01)

(52) U.S. Cl.
CPC ..... *E02F 9/264* (2013.01); *E02F 3/32* (2013.01); *E02F 9/261* (2013.01)

(58) Field of Classification Search
CPC ..... E02F 9/264; E02F 3/32; E02F 9/261
See application file for complete search history.

(56) References Cited

U.S. PATENT DOCUMENTS 4,974,349 A 12/1990 Timmons
5,826,666 A 10/1998 Tozawa et al.
(Continued)

FOREIGN PATENT DOCUMENTS

CN 102071717 A 5/2011
JP 09-228404 A 9/1997
(Continued)

OTHER PUBLICATIONS

English Translation of Nogi et al. (WO2020039833A1), which was cited by Applicant. Publication Date: Feb. 7, 2020.*
(Continued)

*Primary Examiner* — Ramya P Burgess
*Assistant Examiner* — Chanmin Park
(74) *Attorney, Agent, or Firm* — Oblon, McClelland, Maier & Neustadt, L.L.P.

(57) ABSTRACT

Provided is a compaction management system capable of accurately managing the compaction state of a compaction target ground. The compaction management system includes a compaction-pressing-record production unit, a storage device, and a final-compaction-pressing-record selection unit. The compaction pressing record production unit produces a plurality of compaction pressing records, each of which includes the pressing compaction position and the compaction pressing force which are associated with each other. The storage device stores the plurality of compaction pressing records. The final-compaction-pressing-record selection unit selects a selection target compaction pressing force record including the largest compaction pressing force among a plurality of selection target compaction pressing records, which are included in the plurality of compaction pressing records stored in the storage device and produced with respect to the same compaction pressing position, as the
(Continued)

final compaction pressing force record with respect to the compaction pressing position.

4 Claims, 8 Drawing Sheets

(56) References Cited

U.S. PATENT DOCUMENTS

| | | | | |
|---|---|---|---|---|
| 2017/0284070 | A1* | 10/2017 | Matsuyama | E02F 9/20 |
| 2020/0018045 | A1* | 1/2020 | Sano | G06T 7/593 |
| 2021/0062460 | A1 | 3/2021 | Chiba et al. | |

FOREIGN PATENT DOCUMENTS

| | | | |
|---|---|---|---|
| JP | 2000-352044 | A | 12/2000 |
| JP | 2002-115271 | A | 4/2002 |
| JP | 2010-84383 | A | 4/2010 |
| JP | 2012-026113 | A | 2/2012 |
| JP | 5555367 | B1 | 7/2014 |
| JP | 2015-098673 | A | 5/2015 |
| JP | 2020-033781 | A | 3/2020 |
| KR | 10-2010-0037954 | A | 4/2010 |
| WO | WO 2020/039833 | A1 | 2/2020 |

OTHER PUBLICATIONS

Extended European Search Report Issued Sep. 28, 2023 in European Application 21811899.0, 6 pages.
International Search Report issued Jul. 20, 2021 in PCT/JP2021/018593 filed on May 17, 2021, 2 pages.

* cited by examiner

COMPACTION MANAGEMENT SYSTEM

TECHNICAL FIELD

The present invention relates to a compaction management system for managing a compaction state of compaction target ground.

BACKGROUND ART

Patent Document 1 discloses an apparatus including a compaction pressing device and a management means. The compaction pressing device is provided in the work machine to compact the top of slope of banking. The management means integrates the compaction time for each compaction place, thereby quantitatively managing the compaction state of the top of slope according to the compaction time.

Patent Document 2 discloses a management system for making a monitor display positions through which a construction machine for compaction has travelled with different colors on map data. The management system, when the construction machine has travelled through the same position a plurality of times, makes the monitor display the position with a color that is changed in accordance with the number of the times.

The apparatus described in Patent Document 1, which may enable the compaction state of each location to be estimated based on the compaction time, cannot accurately manage the compaction pressing force applied to the location. On the other hand, the system described in Patent Document 2, which may enable the number of times of the pressing work performed at each position to be grasped, cannot allow it to be judged whether or not a target compaction pressing force has been applied to the position. This results in the difficulty of accurate management of the compaction state of the compaction target ground.

CITATION LIST

Patent Literature

Patent Literature 1: Japanese Unexamined Patent Publication No. 2012-226113

Patent Literature 2: Japanese Unexamined Patent Publication No. 2015-98673

SUMMARY OF INVENTION

It is an object of the present invention to provide a compaction management system capable of accurate management of the compaction state of a compaction target ground.

Provided is a compaction management system for managing a compaction state of a compaction target ground, the compaction management system comprising: a work machine; a compaction-pressing-position calculation unit; a compaction-pressing force calculation unit; a compaction-pressing-record production unit; a storage device; a storage control unit; and a final-compaction-pressing-record selection unit. The work machine includes: a machine body; a work device attached to the machine body capably of vertically rotational movement; a work actuator capable of rotationally moving the work device hydraulically; a machine body posture detector that detects a machine body posture which is a posture of the machine body; a work device posture detector that detects a work device posture that is a posture of the work device; a working pressure detector that detects a working pressure of the work actuator; and a dimension storage device that stores a work device dimension that is a dimension of the work device. The compaction-pressing-position calculation unit calculates a compaction pressing position which is a position at which the working device is pressed against the compaction target ground, based on the machine body posture detected by the machine body posture detector, the work device posture detected by the work device posture detector, and the work device dimension stored in the dimension storage device, when the work device is pressed against the compaction target ground. The compaction-pressing-force calculation unit calculates a compaction pressing force applied to the compaction target ground, based on the machine body posture detected by the machine body posture detector, the working device posture detected by the work device posture detector, the working pressure detected by the working pressure detector, and the work device dimension stored in the dimension storage device, when the work device is pressed against the compaction target ground. The compaction-pressing-record production unit produces a plurality of compaction pressing records, each of which includes a combination of the compaction pressing position calculated by the compaction-pressing-position calculation unit and the compaction pressing force calculated by the compaction-pressing-force calculation unit and associated with the compaction pressing position. The storage control unit makes the storage device store the plurality of compaction pressing records produced by the compaction-pressing-record production unit. The final-compaction-pressing-record selection unit selects a selection target compaction pressing record including the largest compaction pressing force among a plurality of selection target compaction pressing records, which are included in the plurality of compaction pressing records stored in the storage device and produced with respect to the same compaction pressing position, as a final selection target compaction pressing record with respect to the compaction pressing position.

DESCRIPTION OF EMBODIMENTS

Figure 2:
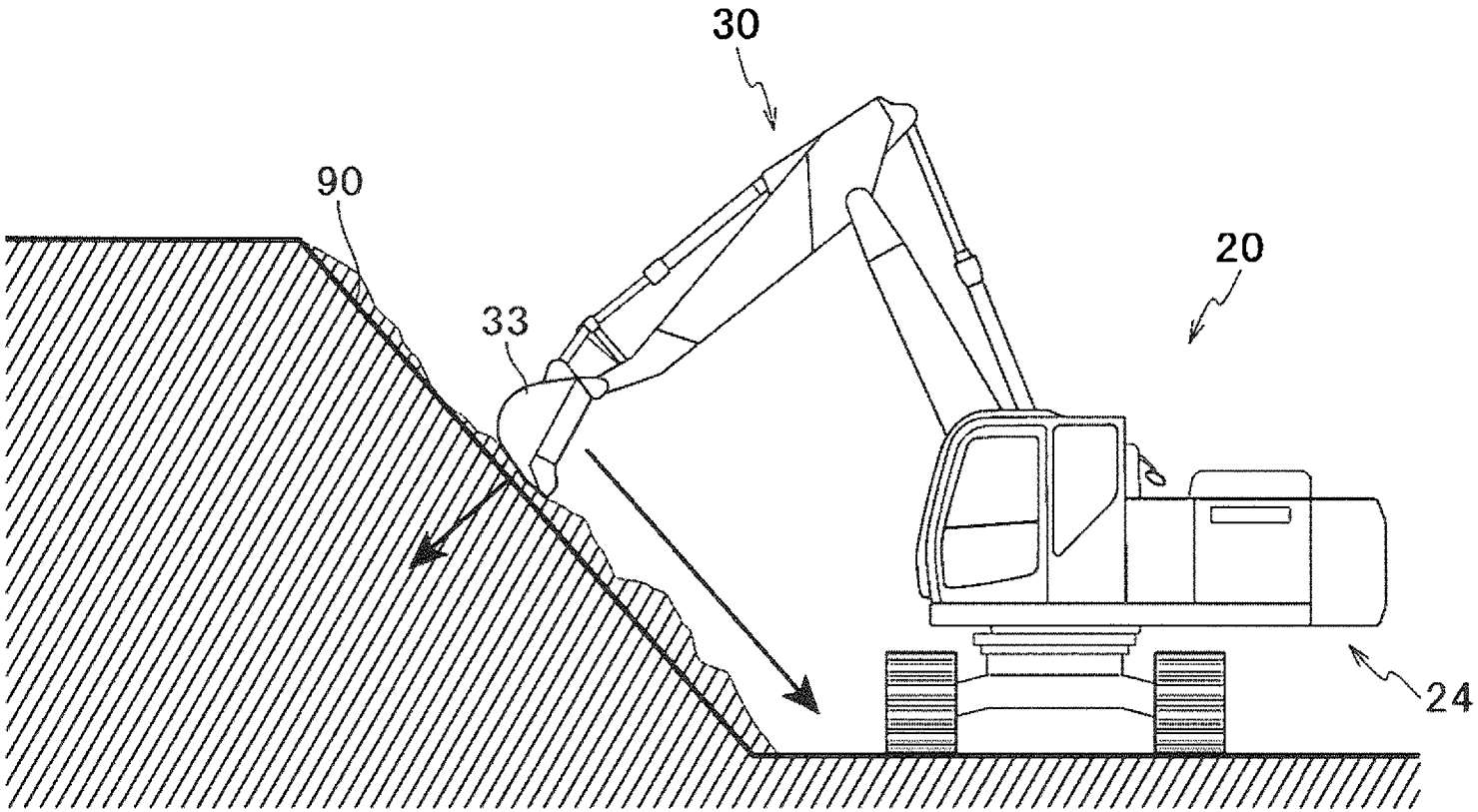
FIG. 2 is a side view showing the work machine which is performing work.
Figure 3:
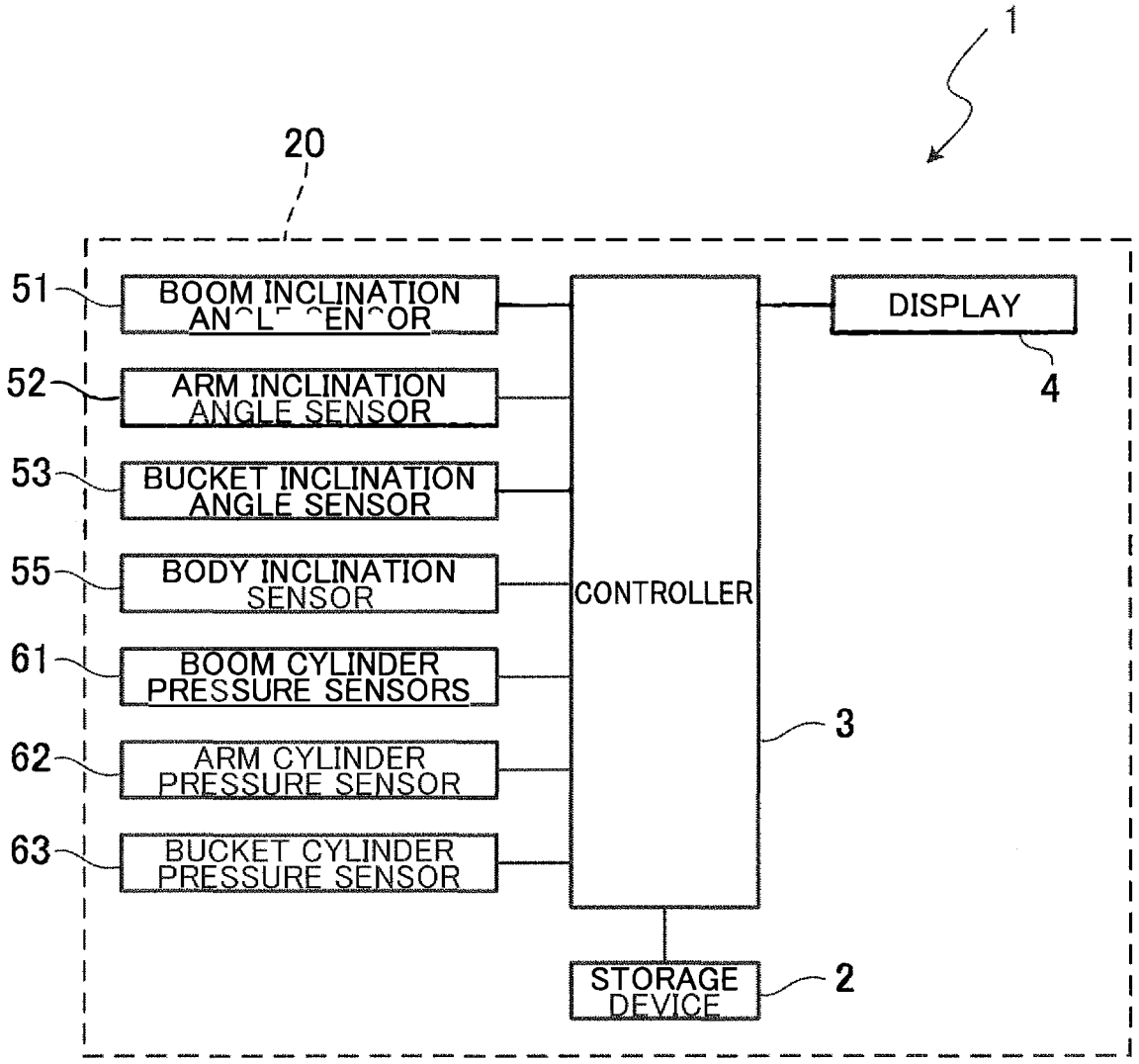
FIG. 3 is a circuit diagram of a compaction management system according to the first embodiment.

Hereinafter will be described preferred embodiments according to the present invention with reference to the drawings FIG. 3 shows a compaction management system 1 according to the first embodiment of the present invention. The compaction management system 1 manages the compaction state of a compaction target ground, including a work machine 20 shown in FIGS. 1 to 3.

Figure 1:
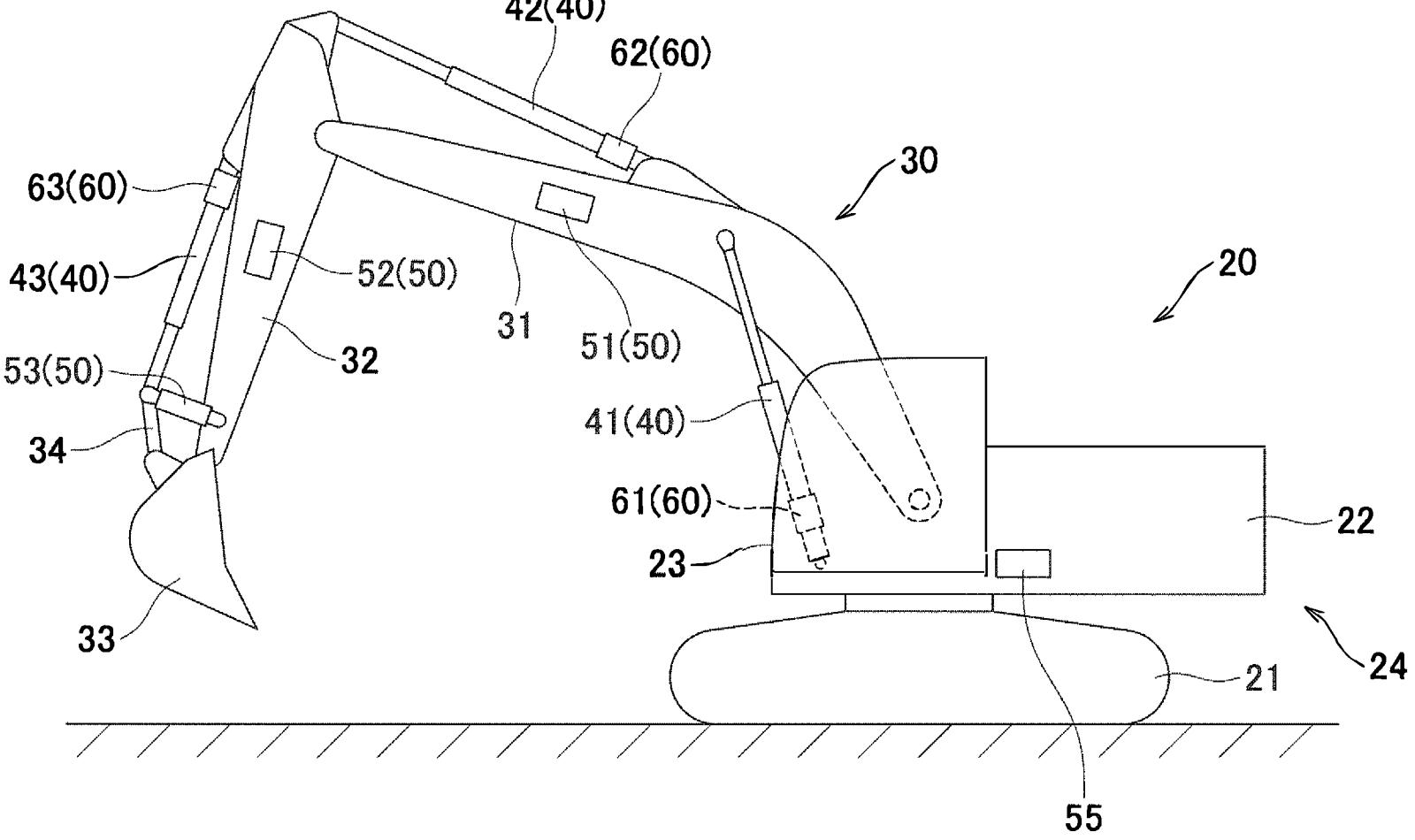
FIG. 1 is a side view of a work machine according to a first embodiment of the present invention.

FIG. 1 is a side view of the work machine 20. The work machine 20 includes an attachment 30 shown in FIG. 1, the attachment 30 serving as a work device capable of performing compaction work. The work machine 20 is, for example, a hydraulic excavator. The work machine 20 includes a machine body 24, the attachment 30, and a plurality of hydraulic cylinders 40

The machine body 24 includes a lower traveling body 21 and an upper turning body 22. The lower traveling body 21 is capable of traveling on the ground, including, for example, crawlers. The upper turning body 22 is mounted on an upper part of the lower traveling body 21 through a turning device capably of turning. A cab (operation room) 23 is provided in a front part of the upper turning body 22.

The attachment 30 is attached to the upper turning body 22 capably of vertically rotational movement. The attachment 30 includes a boom 31, an arm 32, and a bucket 33. The boom 31 includes a proximal end attached to the upper turning body 22 capably of vertically rotational movement, that is, capably of being raised and lowered, and a distal end on the opposite side to the proximal end. The arm 32 includes a proximal end rotatably connected to the distal end of the boom 31 and a distal end on the opposite side to the proximal end. The bucket 33 is rotatably attached to the distal of the arm 32. The bucket 33 is a part capable of performing predetermined work, for example, excavation, leveling, and rake, in contact with a work object such as earth and sand.

The plurality of hydraulic cylinders 40 constitute a work actuator capable of rotationally moving the attachment 30 hydraulically. Each of the hydraulic cylinders 40 performs an expansion and contraction motion of axially expanding and contracting hydraulically. The plurality of hydraulic cylinders 40 include a boom cylinder 41, an arm cylinder 42, and a bucket cylinder 43.

The boom cylinder 41 is provided between the upper turning body 22 and the boom 31 so as to cause the boom 31 to be brought into vertically rotational movement to the upper turning body 22, that is, so as to cause the boom 31 to perform rising and falling motion, by the expansion and contraction motion of the boom cylinder 41. The boom cylinder 41 has a proximal end and a distal end opposite to the proximal end. The proximal end is rotatably connected to the upper turning body 22. The distal end is rotatably connected to the boom 31.

The arm cylinder 42 is provided between the arm 32 and the boom 31 so as to cause the arm 32 to be brought into vertically rotational movement to the boom 31 by the expansion and contraction motion of the arm cylinder 42. The arm cylinder 42 has a proximal end and a distal end opposite to the proximal end. The proximal end is rotatably connected to the boom 31. The distal end is rotatably connected to the arm 32.

The bucket cylinder 43 is provided between the bucket 33 and the arm 32 so as to cause the bucket 33 to be brought into vertically rotational movement to the arm 32 by the expansion and contraction motion of the bucket cylinder 43. The bucket cylinder 43 has a proximal end and a distal end opposite to the proximal end. The proximal end is rotatably connected to the arm 32. The distal end is connected to the bucket 33 through a link member 34. The link member 34 has a proximal end and a distal end opposite to the proximal end. The proximal end is rotatably connected to the distal end of the bucket cylinder 43, and the distal end is rotatably connected to an appropriate part of the bucket 33.

The work machine 20 includes a plurality of inclination angle sensors 50, a body inclination angle sensor 55, and a plurality of pressure sensors 60.

The plurality of inclination angle sensors 50 constitute a work device posture detector that detects a work device posture. The work device posture is the posture of the work device, namely, the posture of the attachment 30 in this embodiment. The plurality of inclination angle sensors 50 include a boom inclination angle sensor 51, an arm inclination angle sensor 52, and a bucket inclination angle sensor 53.

The boom inclination angle sensor 51 is attached to the boom 31 to detect the posture of the boom 31. The boom inclination angle sensor 51 is, specifically, a sensor to acquire an inclination angle of the boom 31 to a horizontal plane, for example, an inclination sensor composed of an acceleration sensor or the like. The boom inclination angle sensor 51, alternatively, may be an angle sensor that detects a boom angle or a stroke sensor that detects an expansion stroke of the boom cylinder 41. The boom angle is a rotational angle of the boom 31, for example, a rotational angle of the boom 31 around a boom foot pin that interconnects the proximal end of the boom 31 and the upper turning body 22.

The arm inclination angle sensor 52 is attached to the arm 32 to detect the posture of the arm 32. The arm inclination angle sensor 52 is, specifically, a sensor to acquire an inclination angle of the arm 32 to a horizontal plane, for example, an inclination sensor composed of an acceleration sensor or the like. The arm inclination angle sensor 52, alternatively, may be a rotational angle sensor that detects an arm angle or a stroke sensor that detects an expansion stroke of the arm cylinder 42. The arm angle is a rotational angle of the arm 32 to the boom 31, for example, a rotation angle of the arm 32 around an arm connection pin that interconnects the proximal end of the arm 32 and the distal end of the boom 31.

The bucket inclination angle sensor 53 is attached to, for example, the link member 34 to detect the posture of the bucket 33. Specifically, the bucket inclination angle sensor 53 is a sensor that acquires an inclination angle of the bucket 33 to a horizontal plane, and is, for example, an inclination sensor composed of an acceleration sensor or the like. The bucket inclination angle sensor 53, alternatively, may be a rotational angle sensor that detects a bucket angle or a stroke sensor that detects an expansion stroke of the bucket cylinder 43. The bucket angle is a rotational angle of the bucket 33 to the arm 32, for example, a rotational angle of the bucket 33 around a bucket connection pin that interconnects a proximal end of the bucket 33 and the distal end of the arm 32.

The body inclination angle sensor 55 is attached to the upper turning body 22 to constitute a machine body posture detector for detecting a machine body posture. The machine body posture is a posture of the machine body 24 in this embodiment. The body inclination angle sensor 55 is, specifically, a sensor to acquire an inclination angle of the machine body 24 to a horizontal plane, for example, a two-axes inclination sensor composed of acceleration sensor or the like.

The plurality of pressure sensors 60 constitute a working pressure detector that detects the working pressure of the work actuator. In this embodiment, the working pressure of the working actuator is the operating pressure of each of the hydraulic cylinders 40.

The plurality of pressure sensors 60 include boom cylinder pressure sensors 61, an arm cylinder pressure sensor 62, and a bucket cylinder pressure sensor 63. The boom cylinder pressure sensors 61 are attached to the boom cylinder 41 to detect respective pressures of hydraulic fluid in a bottom-side chamber (head-side chamber) and a rod-side chamber of the boom cylinder 41, namely, a bottom-side pressure Ph and a rod-side pressure Pr, respectively. The arm cylinder pressure sensor 62 is attached to the arm cylinder 42 to detect a bottom-side pressure which is the pressure of hydraulic fluid in a bottom-side chamber of the arm cylinder 42. The bucket cylinder pressure sensor 63 is attached to the bucket cylinder 43 to detect a bottom-side pressure which is the pressure of hydraulic fluid in a bottom-side chamber of the bucket cylinder 43.

FIG. 2 is a side view showing the work machine 20 which is performing work. The work includes leveling work of leveling a compaction target ground 90 with the bucket 33 and compaction work of compacting the compaction target ground 90. In the compaction work, as shown in FIG. 2, the bottom surface of the bucket 33 is pressed against the compaction target ground 90. To the place against which the bucket 33 is thus pressed in the compaction target ground 90, a compaction pressing force is applied.

FIG. 3 is a circuit diagram of the compaction management system 1. The compaction management system 1 includes a storage device 2 and a controller 3 shown in FIG. 3, in addition to the work machine 20. The storage device 2 and the controller 3 are provided in the work machine 20.

The storage device 2 is capable of storing a work device dimension. The work device dimension is the dimension of the work device, namely, the dimension of the attachment 30 in this embodiment. The controller 3 includes a compaction-pressing-position calculation unit that calculates a compaction pressing position. The compaction pressing position is a position at which the working device is pressed against the compaction target ground; in this embodiment, the position of the bucket 33 is calculated as the compaction pressing position. When the bucket 33 is pressed against the compaction target ground 90, the compaction-pressing-position calculation unit of the controller 3 calculates the position of the bucket 33 based on the machine body posture detected by the body inclination angle sensor 55, that is, the posture of the machine body 24, the work device posture detected by the inclination angle sensors 50, that is, the posture of the attachment 30, and the work device dimension stored in the storage device 2, that is, the dimension of the attachment 30. In this embodiment, the calculated position of the bucket 33 is a two-dimensional position on a vertical plane, in which the attachment 30 make motions.

The controller 3 further includes a compaction-pressing-force calculation unit, which calculates a compaction pressing force that is applied to the compaction target ground 90, based on the machine body posture detected by the body inclination angle sensor 55, that is, the posture of the machine body 24, the work device posture detected by the inclination angle sensors 50, that is, the posture of the attachment 30, the working pressures detected by the plurality of pressure sensors 60, respectively, and the work device dimension stored in the storage device 2, that is, the dimension of the attachment 30, when the bucket 33 is pressed against the compaction target ground.

The compaction-pressing-force calculation unit of the controller 3 calculates respective cylinder lengths of the boom cylinder 41, the arm cylinder 42, and the bucket cylinder 43, which are the lengths in the expansion and contraction direction, based on the posture of the attachment 30 detected by the inclination angle sensors 50, namely, the work device posture. The controller 3 further calculates respective center-of-gravity positions of the boom 31, the arm 32, and the bucket 33 based on the calculated respective cylinder lengths. The thus calculated center-of-gravity positions are stored in the storage device 2.

On the other hand, the compaction-pressing-force calculation unit calculates a cylinder thrust Fct of the boom cylinder 41 based on the bottom-side pressure Ph and the rod-side pressure Pr of the boom cylinder 41 detected by the boom cylinder pressure sensors 61. The cylinder thrust Fct is represented by the following formula when the thrust in the extension direction of the boom cylinder 41 is positive.

$$Fct=Ph*Ah-Pr*Ar$$

Herein, Ah is a cross-sectional area of the bottom-side chamber of the boom cylinder 41, and Ar is a cross-sectional area of the rod-side chamber of the boom cylinder 41. In general, the cross-sectional area Ar of the rod-side chamber of the boom cylinder 41 is smaller than the cross-sectional area Ah of the bottom-side chamber by an amount of the cross-sectional area of the cylinder rod.

The compaction-pressing-force calculation unit calculates a self-weight moment Mw of the attachment 30 based on the center-of-gravity positions of the boom 31, the arm 32, and the bucket 33 which are calculated as described above. The self-weight moment Mw is a downward moment, about a boom foot that is the turning fulcrum of the boom 31, caused by the self-weight of the attachment 30. Besides, the controller 3 calculates a thrust moment Mct that is caused by the cylinder thrust Fct. The thrust moment Met is an upward moment when the cylinder thrust Fct is positive. The controller 3 further calculates a pressing force Fp by which the tip of the bucket 33 is pressed against the compaction target ground 90, based on the self-weight moment Mw and the thrust moment Mct.

The compaction pressing force F ($kN/m^2$) is calculated by dividing the calculated value of the component of the pressing force Fp (kN) in the normal direction of the bottom surface of the bucket 33 by the area ($m^2$) of the bottom surface of the bucket 33.

The controller 3 further includes a compaction-pressing-record production unit that produces a plurality of compaction pressing records. Each of the compaction pressing records is a record including the combination of the compaction pressing position calculated by the compaction-pressing-position calculation unit, that is, the position of the bucket 33, and the compaction pressing force calculated by the compaction-pressing-force calculation unit and associated with the compaction pressing position.

The controller 3 further includes a storage control unit that makes the storage device 2 store the plurality of produced compaction pressing records. In general compaction work, compaction pressing forces are applied to the same position of the compaction target ground 90 over a plurality of times. This causes the plurality of compaction pressing records to be produced every time the compaction pressing force is applied to the same position and stored in the storage device 2 at that time. Hence, the plurality of compaction pressing records produced by the compaction pressing record production unit and stored in the storage device 2 generally include a plurality of selection target compaction pressing records that are a plurality of compaction pressing records produced with respect to the same compaction pressing position.

The controller 3 further includes a final-compaction-pressing-record selection unit that selects one final compaction pressing record from among the plurality of selection target compaction pressing records. When the plurality of selection target compaction pressing records produced with respect to the same compaction pressing position, that is, the position of the bucket 33, are included in the plurality of compaction pressing records stored in the storage device 2, the final-compaction-pressing-record selection unit selects, as the final compaction pressing record with respect to the compaction pressing position, the compaction pressing record including the largest compaction pressing force among the plurality of target selection compaction pressing records. This enables the maximum value of the compaction pressing force applied to the compaction target ground 90 at the compaction position where the compaction of the compaction target ground 90 is performed to be managed as the compaction pressing force with respect to the compaction pressing position, thereby enabling the compaction state of the compaction target ground 90 to be accurately managed.

The compaction management system 1 further includes a display 4 as a display device. The display 4 is provided in the cab 23 of the work machine 20.

The controller 3 further includes a display control unit. The display control unit makes the display 4 display the compaction pressing position and the compaction pressing force included in the final compaction pressing record that is selected by the final-compaction-pressing-record selection unit of the controller 3. The display allows a worker who operates the work machine 20 to visually grasp the compaction state of the compaction target ground 90.

Figure 4A:
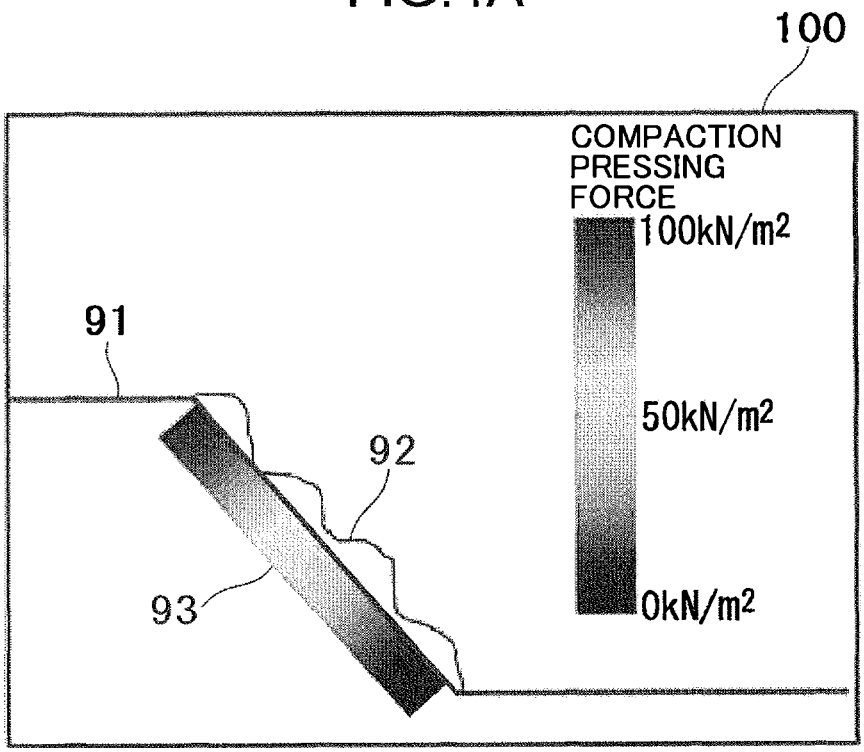
FIG. 4A is a view showing a compaction-pressing-record management screen displayed on a display in the first embodiment, wherein a history image has not been updated yet.
Figure 4B:
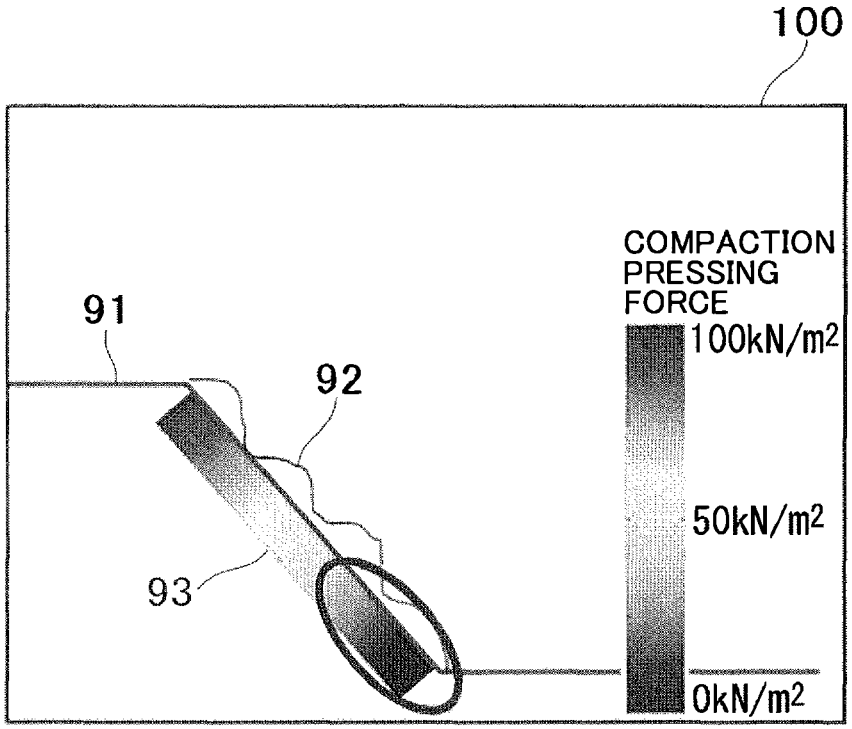
FIG. 4B is a diagram showing a compaction-pressing-record management screen displayed on the display in the first embodiment, wherein the history image has been updated.

FIGS. 4A and 4B show a compaction-pressing-record management screen 100 displayed on the display 4. The compaction-pressing-record management screen 100 includes a design surface image 91, a trajectory image 92, and a history image 93. The design surface image 91 is an image indicating a design surface of the compaction target ground 90, that is, a surface to be the target of the surface of the compaction target ground 90. The trajectory image 92 is an image indicating the trajectory of the tip of the bucket 33. The history image 93 is an image indicating the magnitudes of the compaction pressing forces applied to the compaction target ground 90 by different colors. The images 91 to 93 allow the distribution of the compaction pressing forces to be grasped at a glance.

Assumed is a case where compaction pressing forces are applied a plurality of times to the compaction target ground 90 to thereby render, for example, the compaction pressing force that is applied to the lower part of the compaction target ground 90 larger than the compaction pressing force when the compaction-pressing-record management screen 100 shown in FIG. 4A is displayed. In this case, as shown in FIG. 4B, the history image 93 is updated so as to show the maximum value of the compaction pressing force in the part enclosed by a closed curve in the lower region of the compaction target ground 90 in the history image 93.

The compaction-pressing-record management screen 100 is not limited to one shown in FIGS. 4A and 4B. In the compaction-pressing-record management screen 100 may be displayed as a text, for example, data of the position of the bucket 33 and the numerical value of the maximum compaction pressing force applied to the position.

Figure 5A:
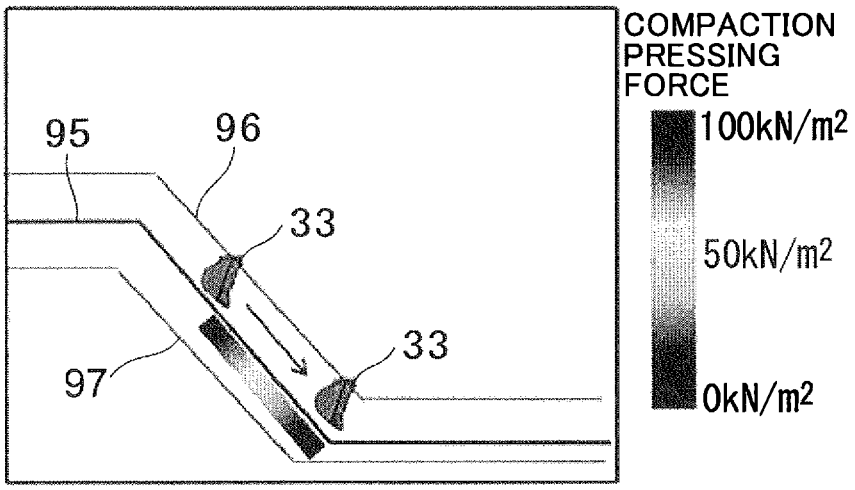
FIG. 5A is a diagram showing an example of a case where a compaction pressing record is produced with respect to a compaction target ground.
Figure 5B:
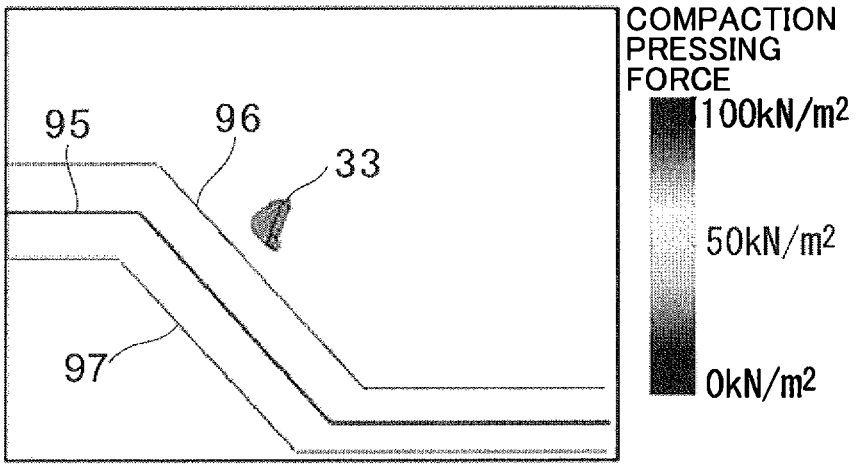
FIG. 5B is a diagram showing an example of a case where the production of a compaction pressing record with respect to the compaction target ground is suspended.

The storage device 2 stores information about a design surface of the compaction target ground 90 and information about a tolerance given to the design surface. The compaction-pressing-record production unit of the controller 3 produces the compaction pressing record on condition that the compaction pressing position calculated by the compaction-pressing-position calculation unit of the controller 3, that is, the position of the bucket 33, is within the tolerance of the design surface. In other words, when the calculated position of the bucket 33 is deviated from the tolerance of the design surface, the compaction-pressing-record production unit suspends the production of the compaction pressing record. FIGS. 5A and 5B show an example of the relative position of the bucket 33 to the design surface, wherein the design surface is indicated by the line 95 and the tolerance given to the design surface is indicated by lines 96 and 97. When the position of the bucket 33 is within the tolerance of the design surface as illustrated in FIG. 5A, that is, inside the allowance area defined by the lines 96 and 97, the compaction-pressing-record production unit produces the compaction pressing record; when the position of the bucket 33 is deviated from the tolerance of the design surface as illustrated in FIG. 5B, that is, outside the allowance area, the compaction-pressing-record production unit suspends the production of the compaction pressing record.

Thus suspending the production of the compaction pressing record when the calculated position of the bucket 33 is deviated from the tolerance of the design surface of the compaction target ground 90 prevents the maximum value of the compaction pressing force from being updated when the normal construction fails to be performed, thereby enabling the compaction state of the compaction target ground 90 to be more accurately managed.

In the case where the plurality of compaction pressing records stored in the storage device 2 include a plurality of selection target compaction pressing records produced with respect to the same compaction pressing position within the tolerance of the design surface, the final-compaction-pressing-record selection unit of the controller 3 selects the compaction pressing record including the largest compaction pressing force among the plurality of compaction pressing records, that is, the plurality of selection target compaction pressing records, as the final compaction pressing record with respect to the compaction pressing position. Specifically, in the compaction work, there can be a case where a plurality of applications of the compaction pressing force to the same position on the compaction target ground 90 causes the ground to be so compacted as to vary the position of the bucket 33. In this case, each of the compaction pressing forces applied at the same compaction pressing position on the design surface within the tolerance can be regarded as the compaction pressing force applied to the position. The final compaction-pressing-record production unit selects the compaction pressing record including the largest compaction pressing force among the plurality of selection target compaction pressing records produced with respect to the same compaction pressing position within the tolerance as the final compaction pressing record with respect to the compaction pressing position, thereby enabling the maximum value of the compaction pressing force applied to the compaction target ground at the compaction pressing position within the tolerance of the design surface to be managed as the compaction pressing force corresponding to the compaction pressing position. This enables the compaction state of the compaction target ground 90 to be managed more accurately.

As described above, the compaction pressing record production unit of the compaction management system 1 according to the present embodiment produces a plurality of compaction pressing records, each of which includes the combination of the position of the bucket 33 when the bucket 33 is pressed against the compaction target ground 90 and the compaction pressing force applied to the compaction target ground 90 associated with the position. The storage control unit makes the storage device 2 store the plurality of compaction pressing records. The plurality of compaction pressing records include records produced every time the compaction pressing force is applied to the compaction target ground at the same compaction pressing position, and the compaction pressing record is stored in the storage device 2 at that time. In the case where the plurality of compaction pressing records stored in the storage device 2 include a plurality of selection target compaction pressing records that are produced with respect to the same compaction pressing position, the final-compaction-pressing-record selection unit selects the compaction pressing record including the largest compaction pressing force among the plurality of selection target compaction pressing records as the final compaction pressing record with respect to the position. This enables the maximum value of the compaction pressing force applied at the compaction pressing position for compaction of the compaction target ground 90 to be managed as the compaction pressing force with respect to the compaction pressing position, thereby enabling the compaction state of the compaction target ground 90 to be accurately managed.

The compaction-pressing-record production unit produces a compaction pressing record on condition that the calculated compaction pressing position, that is, the position of the bucket 33, is within the tolerance of the design surface of the compaction target ground 90, and the compaction pressing record is stored in the storage device 2. In other words, when the calculated position of the bucket 33 is deviated from the tolerance of the design surface of the compaction target ground 90, the compaction-pressing-record production unit suspends the production of the compaction pressing record to prevent the maximum value of the compaction pressing force from being updated. This makes it possible to manage the compaction state of the compaction target ground 90 more accurately.

In the case where the plurality of compaction pressing records stored in the storage device 2 include a plurality of selection target compaction pressing records produced with respect to the same compaction pressing position within the tolerance of the design surface, the final-compaction-pressing-record selection unit selects the compaction pressing record including the largest compaction pressing force among the plurality of selection target compaction pressing records as the final compaction pressing record with respect to the compaction pressing position. This allows the maximum value of the compaction pressing force applied at the compaction pressing position within the tolerance of the design surface to be managed as the compaction pressing force corresponding to the compaction pressing position, enabling the compaction state of the compaction target ground 90 to be more accurately managed.

Besides, the display control unit of the controller 3 makes the display 4 as a display device display the maximum compaction pressing force among the compaction pressing forces applied to the compaction target ground 90 at a certain compaction pressing position and the certain compaction pressing position, thereby enabling the compaction state of the compaction target ground 90 to be visually grasped.

Next will be described a compaction management system according to a second embodiment of the present invention with reference to the drawings. The configuration common to the first embodiment and the effects achieved by the same are omitted, and the points different from the first embodiment will be mainly described in the second embodiment. Besides, the elements common to elements included in the first embodiment of the elements included in the second embodiment are denoted by the same reference numerals.

Figure 6:
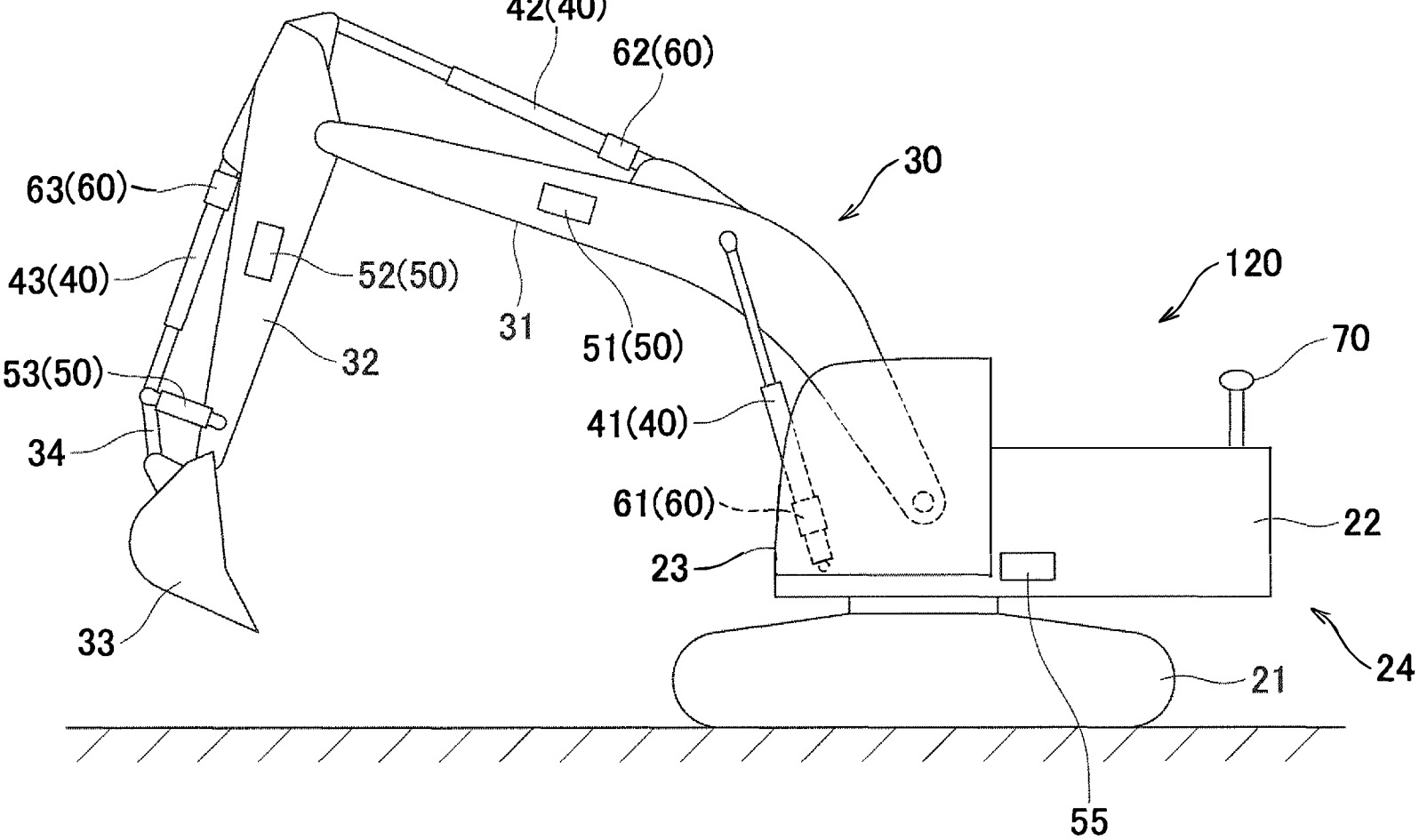
FIG. 6 is a side view of a work machine according to a second embodiment of the present invention.

FIG. 6 is a side view of a work machine 120 according to the present embodiment. As shown in FIG. 6, the work machine 120 further includes a GNSS device 70 in addition to elements equivalent to that included in the work machine 120 according to the first embodiment. The GNSS device 70 is provided in a machine body 24 of the work machine 120 to serve as a machine body position detector that detects a machine body position which is a three-dimensional position of the machine body 24 and a machine body orientation detector that detects a machine body orientation that is an orientation of the machine body 24. The GNSS device 70 includes at least two receivers attached to the upper turning body 22 at respective positions which are apart from each other. Each of the at least two receivers receives a signal transmitted from a positioning satellite for the global positioning satellite system (GNSS). The GNSS device 70 detects the time at which the signal is transmitted, based on the signals received by the at least two receivers, and detects the three-dimensional position of the machine body 24 using the radio wave velocity and the radio wave transmission time (the difference between the transmission time and the arrival time). In addition, the GNSS device 70 detects the orientation of the upper turning body 22 to detect the orientation of the attachment 30 based on the deviation of respect signals received by the at least two receivers from each other.

Figure 7:
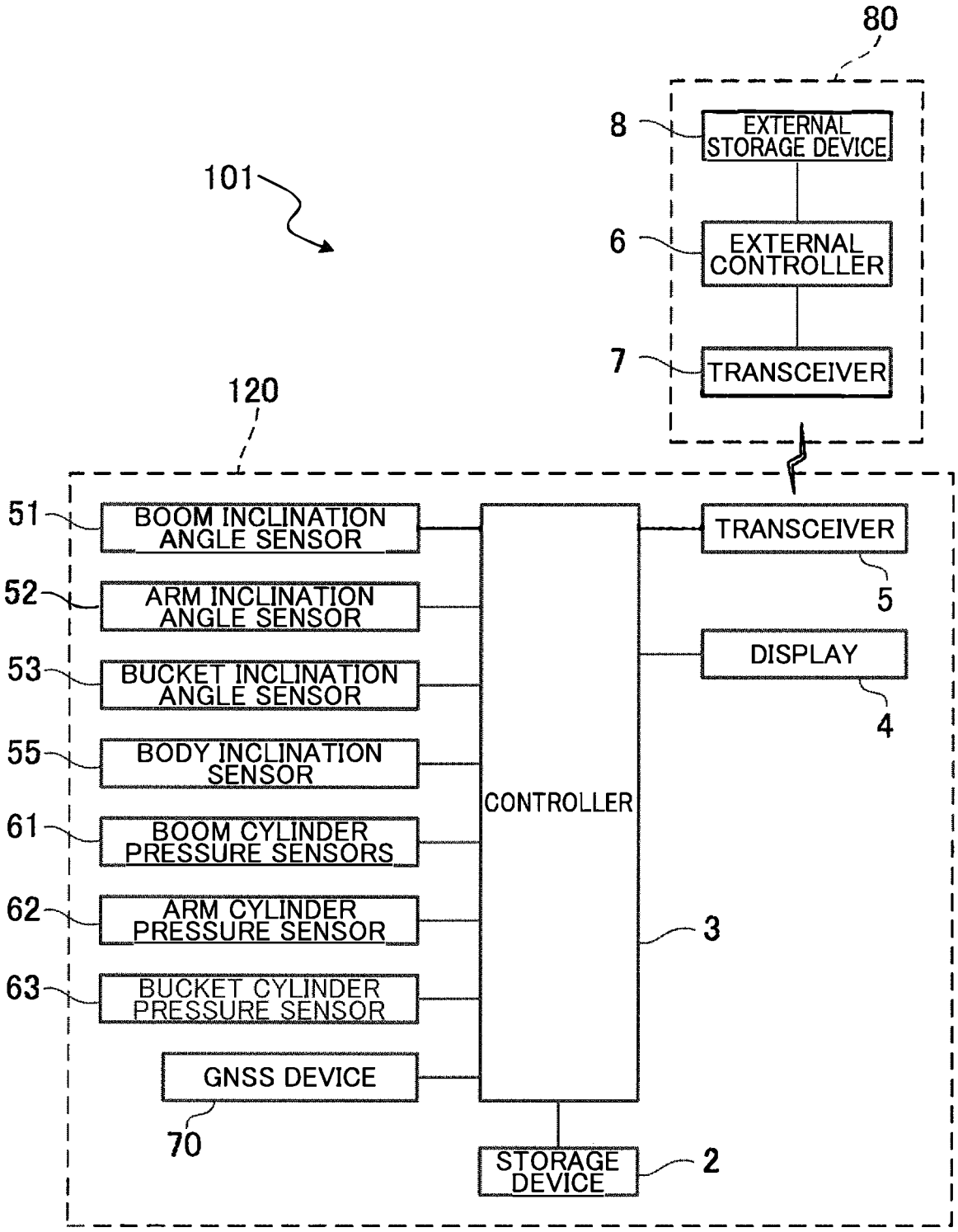
FIG. 7 is a circuit diagram of a compaction management system according to the second embodiment.

FIG. 7 is a circuit diagram of a compaction management system 101 according to the present embodiment. As shown in FIG. 7, the compaction management system 101 further includes a transceiver 5 and an external management device 80 in addition to elements equivalent to that included in the compaction management system 1 according to the first embodiment. The transceiver 5 is provided in the work machine 120, being capable of transmitting and receiving information to/from the outside. The external management device 80 is provided outside the work machine 120. The external management device 80 is, for example, a server or a cloud. The external management device 80 includes an external controller 6, a transceiver 7, and an external storage device 8. The transceiver 7 is capable of transmitting and receiving information to/from the outside.

The controller 3 of the work machine 120 includes a compaction-pressing-position calculation unit similar to the controller 3 according to the first embodiment. The compaction-pressing-position calculation unit, when the bucket 33 of the work machine 120 is pressed against the compaction target ground, calculates the three-dimensional position of a work device, namely, the three-dimensional position of a bucket 33 in this embodiment, based on a machine body posture detected by the body inclination angle sensor 55, that is, the posture of a machine body 24, a work device posture detected by a plurality of inclination angle sensors 50, that is, the posture of an attachment 30, and the three-dimensional position and the orientation of the machine body 24 detected by the GNSS device 70. The thus obtained three-dimensional position of the bucket 33, that is, the three-dimensional compaction pressing position, allows the compaction-pressing-record production unit of the controller 3 to produce a plurality of compaction pressing records in three dimensions, thereby enabling the compaction state of the compaction target ground 90 to be managed in three dimensions.

Figure 8A:
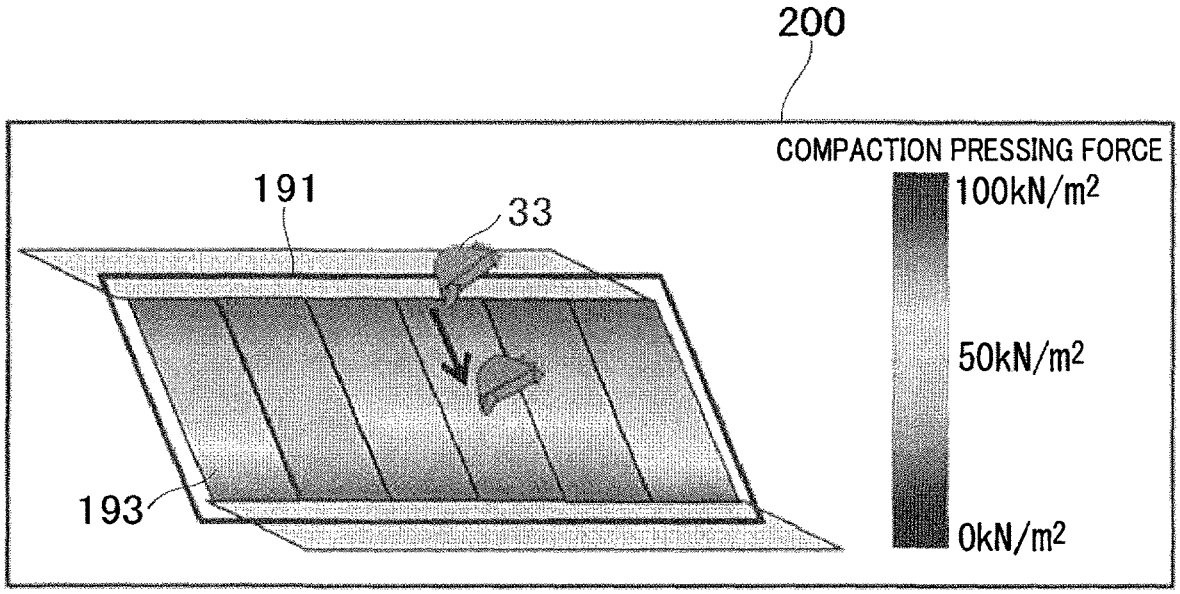
FIG. 8A is a view showing a compaction-pressing-record management screen displayed on a display in the second embodiment, wherein a history image has not been updated yet.
Figure 8B:
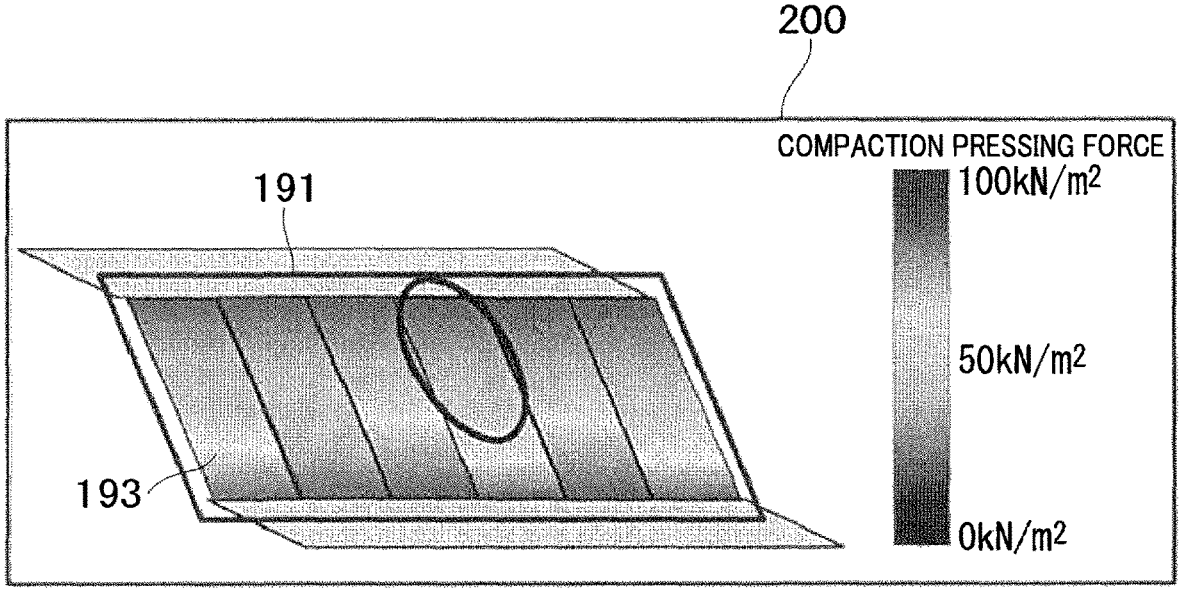
FIG. 8B is a diagram showing a compaction-pressing-record management screen displayed on the display in the second embodiment, wherein the history image has been updated.

FIGS. 8A and 8B show a compaction-pressing-record management screen 200 displayed on a display 4 according to the second embodiment. The compaction-pressing-record management screen 200 includes a design surface image 191 and a history image 193. The design surface image 191 is an image showing the design surface of the compaction target ground 90 in three dimensions. The history image 193 is an image that show magnitudes of compaction pressing forces applied to the compaction target ground 90 by different colors. The images 191 and 193 allow the three-dimensional distribution of the compaction pressing forces to be grasped at a glance.

Assumed is a case where compaction pressing forces are applied to the compaction target ground 90 over a plurality of times to render, for example, the compaction pressing force applied to a part (where the bucket 33 is graphically shown) of the compaction target ground 90 greater than the compaction pressing force when the compaction pressing record management screen 200 shown in FIG. 8A is displayed. In this case, as shown in FIG. 8B, the history image 193 is updated so as to make the maximum value of the compaction pressing force at a corresponding part of the compaction target ground 90, the part enclosed by a closed curve, be displayed in the history image 193.

The final-compaction-pressing-record selection unit of the controller 3 makes the final compaction pressing record selected by the final-compaction-pressing-record selection unit be transmitted from the transceiver 5 to the transceiver 7 of the external management device 80. The external controller 6 of the external management device 80 makes the external storage device 8 store the final compaction pressing record received by the transceiver 7. The final compaction pressing record thus stored in the external storage device 8 is the compaction pressing record including the largest compaction pressing force among the plurality of selection target compaction pressing records produced with respect to the same compaction pressing position within the tolerance of the design surface. This enables the maximum compaction pressing force applied at a certain compaction pressing position within the tolerance of the design surface and the certain compaction pressing position to be managed separately from the work machine 120, thereby enabling the compaction state of the compaction target ground 90 to be unitarily managed outside the work machine 120.

As described above, the compaction-pressing-position calculation unit of the compaction management system 101 according to the present embodiment calculates the compaction pressing position in the three-dimensional space, namely, the three-dimensional position of the bucket 33, based on the detected machine body posture which is the detected posture of the machine body 24, the detected work device posture which is the detected posture of the attachment 30, and the detected machine body position and the machine body orientation which are the three-dimensional position and the orientation of the machine body 24, respectively, when the bucket 33 is pressed against the compaction target ground. Thus obtaining the position of the bucket 33 in three dimensions enables each of the compaction pressing records to be produced in three dimensions, thereby enabling the compaction state of the compaction target ground to be managed in three dimensions.

Besides, the external storage device 8, which is provided outside the work machine 120 and stores the maximum compaction pressing force applied to the compaction target ground at a certain compaction pressing position and the certain compaction pressing position, enables the compaction state of the compaction target ground to be unitarily managed outside the work machine 120.

Although the embodiments of the present invention have been described above, specific examples are merely illustrative, and the present invention is not particularly limited, and specific configurations and the like can be modified as appropriate. The actions and effects described in the embodiments of the present invention are not limited to those described in the embodiments of the present invention, and the effects and effects of the present invention are not limited to those described in the embodiments of the present invention.

As described above, there is provided a compaction management system capable of accurately managing the compaction state of the compaction target ground.

Provided is a compaction management system for managing a compaction state of a compaction target ground, the compaction management system comprising: a work machine; a compaction-pressing-position calculation unit; a compaction-pressing-force calculation unit; a compaction-pressing-record production unit; a storage device; a storage control unit; and a final-compaction-pressing-record selection unit. The work machine includes: a machine body; a work device attached to the machine body capably of vertically rotational movement, a work actuator capable of rotationally moving the work device hydraulically; a machine body posture detector that detects a machine body posture which is a posture of the machine body; a work device posture detector that detects a work device posture that is a posture of the work device; a working pressure detector that detects a working pressure of the work actuator; and a dimension storage device that stores a work device dimension that is a dimension of the work device. The compaction-pressing-position calculation unit calculates a compaction pressing position which is a position at which the working device is pressed against the compaction target ground, based on the machine body posture detected by the machine body posture detector, the work device posture detected by the work device posture detector, and the work device dimension stored in the dimension storage device, when the work device is pressed against the compaction target ground. The compaction-pressing-force calculation unit calculates a compaction pressing force applied to the compaction target ground, based on the machine body posture detected by the machine body posture detector, the working device posture detected by the work device posture detector, the working pressure detected by the working pressure detector, and the work device dimension stored in the dimension storage device, when the work device is pressed against the compaction target ground. The compaction-pressing-record production unit produces a plurality of compaction pressing records, each of which includes a combination of the compaction pressing position calculated by the compaction-pressing-position calculation unit and the compaction pressing force calculated by the compaction-pressing-force calculation unit and associated with the compaction pressing position. The storage control unit makes the storage device store the plurality of compaction pressing records produced by the compaction-pressing-record production unit. The final-compaction-pressing-record selection unit selects a selection target compaction pressing record including the largest compaction pressing force among a plurality of selection target compaction pressing records, which are included in the plurality of compaction pressing records stored in the storage device and produced with respect to the same compaction pressing position, as a final selection target compaction pressing record with respect to the compaction pressing position.

According to this system, a plurality of compaction pressing records each including the combination of the position of the work device when the work device is pressed against the ground to be compacted, namely, the compaction pressing position, and the compaction pressing force applied to the compaction target ground associated with the position are produced and stored in the storage device. The plurality of compaction pressing records are produced every time the compaction pressing force is applied to the same position and stored in the storage device at that time. When the plurality of compaction pressing records stored in the storage device include a plurality of selection target compaction pressing records produced with respect to the same compaction pressing position, the compaction pressing record including the largest compaction pressing force among the plurality of selection target compaction pressing records is selected as the final compaction pressing record with respect to the compaction pressing position. This enables the maximum value of the compaction pressing force applied to the compaction target ground to be managed as the compaction pressing force with respect to that position, thereby enabling the compaction state of the compaction target ground to be accurately managed.

It is preferable that the work machine further includes a machine body position detector that detects a machine body position which is a three-dimensional position of the machine body, and a machine body orientation detector that detects a machine body orientation which is an orientation of the machine body, wherein the compaction-pressing-position calculation unit is configured to calculate the compaction pressing position in three dimensions, based on the machine body posture detected by the machine body posture detector, the work device posture detected by the work device posture detector, the machine body position detected by the machine body position detector, and the machine body orientation detected by the machine body orientation detector, when the work device is pressed against the compaction target ground. The compaction-pressing-position calculation unit, which calculates the compaction pressing position in three dimensions, enables the compaction state of the compaction target ground to be managed in three dimensions.

It is preferable that the storage device stores information about a design surface of the compaction target ground and information about a tolerance given to the design surface, and the compaction-pressing-record production unit is configured to produce the compaction pressing record on condition that the compaction pressing position calculated by the compaction-pressing-position calculation unit is within the tolerance of the design surface. This prevents the pressing compaction record from being produced with respect to the compaction pressing position in spite of the deviation of the compaction pressing position from the tolerance, thereby enabling the compaction state to be managed more accurately.

Hence, it is preferable that the final-compaction-pressing-record selection unit is configured to select the selection target compaction pressing record including the largest compaction pressing force among the plurality of selection target compaction pressing records, which are produced with respect to the same compaction pressing position within the tolerance of the design surface and included in the plurality of compaction pressing records stored in the storage device, as the final compaction pressing record with respect to the compaction pressing position.

It is preferable that the compaction management system further includes a display device and a display control unit that makes the display device display the compaction pressing position and the compaction pressing force that are included in the final compaction pressing record selected by the final-compaction-pressing-record selection unit. This enables the compaction pressing force at each compaction pressing position to be appropriately managed based on the final compaction pressing record relating to the maximum compaction pressing force, the final compaction pressing record being selected from among the plurality of selected compaction pressing records which are produced with respect to the same compaction pressing position.

Preferably, the compaction management system further includes an external storage device that is provided outside the work machine and stores the final compaction pressing record selected by the final-compaction-pressing-record selection unit. This enables the compaction state to be unitarily managed outside the work machine.

The invention claimed is:

1. A compaction management system for managing a compaction state of a compaction target ground, the compaction management system comprising:

a work machine including a machine body, a work device attached to the machine body capably of vertically rotational movement, a work actuator capable of rotationally moving the work device hydraulically, a machine body posture detector that detects a machine body posture which is a posture of the machine body, a work device posture detector that detects a work device posture which is a posture of the work device, a working pressure detector that detects a working pressure of the work actuator, and a dimension storage device that stores a work device dimension which is a dimension of the work device;

a controller provided in the work machine;

a display device; and a storage device that stores information about a design surface of the compaction target ground and information about a tolerance given to the design surface, wherein the controller includes:

a compaction-pressing-position calculation unit that calculates a compaction pressing position which is a position at which the work device is pressed against the compaction target ground, based on the machine body posture detected by the machine body posture detector, the work device posture detected by the work device posture detector, and the work device dimension stored in the dimension storage device, when the work device is pressed against the compaction target ground;

a compaction-pressing-force calculation unit that calculates a compaction pressing force applied to the compaction target ground, based on the machine body posture detected by the machine body posture detector, the work device posture detected by the work device posture detector, the working pressure detected by the working pressure detector, and the work device dimension stored in the dimension storage device, when the work device is pressed against the compaction target ground;

a compaction-pressing-record production unit that produces a plurality of compaction pressing records, each of which includes a combination of the compaction pressing position calculated by the compaction-pressing-position calculation unit and the compaction pressing force calculated by the compaction-pressing-force calculation unit and associated with the compaction pressing position;

a storage control unit that makes the storage device store the plurality of compaction pressing records produced by the compaction-pressing-record production unit;

a final-compaction-pressing-record selection unit that selects a selection target compaction pressing record including the largest compaction pressing force among a plurality of selection target compaction pressing records, which are included in the plurality of compaction pressing records stored in the storage device and produced with respect to the same compaction pressing position, as a final compaction pressing record with respect to the compaction pressing position, a display control unit that makes the display device display the compaction pressing position and the compaction pressing force that are included in the final compaction pressing record selected by the final-compaction-pressing-record selection unit, the displayed compaction pressing position and the displayed compaction force allowing a worker who operates the work machine to visually grasp a compaction state of the compaction target ground, wherein the compaction management system is configured to produce the compaction pressing record on condition that the compaction pressing position calculated by the compaction-pressing-position calculation unit is within the tolerance of the design surface, and configured to suspend the production of the compaction pressing record when the calculated position of the work device is deviated from the tolerance of the design surface, and wherein the final-compaction-pressing-record selection unit is configured to select the selection target compaction pressing record including the largest compaction pressing force among the plurality of selection target compaction pressing records, which are produced with respect to the same compaction pressing position within the tolerance of the design surface and included in the plurality of compaction pressing records stored in the storage device, as the final compaction pressing record with respect to the compaction pressing position.

2. The compaction management system according to claim 1, further comprising:

a machine body position detector that detects a machine body position which is a three-dimensional position of the machine body; and a machine body orientation detector that detects a machine body orientation which is a direction of the machine body, wherein the compaction-pressing-position calculation unit is configured to calculate the compaction pressing position in three dimensions, based on the machine body posture detected by the machine body posture detector, the work device posture detected by the work device posture detector, the machine body position detected by the machine body position detector and the machine body orientation detected by the machine body orientation detector, when the work device is pressed against the compaction target ground.

3. The compaction management system according to claim 1, further comprising:

an external storage device that is provided outside the work machine and stores the final compaction pressing record that is selected by the final-compaction-pressing-record selection unit.

4. The compaction management system according to claim 1, wherein the display control unit that makes the display device display the design surface together with the compaction pressing forces respectively corresponding to a plurality of compaction pressing positions on the design surface, each of the compaction pressing forces and its corresponding compaction pressing position on the design surface being included in the final compaction pressing record selected by the final-compaction-pressing-record selection unit.

* * * * *